US005406707A

United States Patent [19]

Owens et al.

[11] Patent Number: 5,406,707

[45] Date of Patent: Apr. 18, 1995

[54] UTILITY KNIFE WITH IMPROVED SLIDE

[75] Inventors: Robert L. Owens, Shaftsbury; W. Gregory Sawyer, Bennington, both of Vt.

[73] Assignee: The Stanley Works, New Britain, Conn.

[21] Appl. No.: 258,331

[22] Filed: Jun. 10, 1994

Related U.S. Application Data

[63] Continuation-in-part of Ser. No. 184,970, Jan. 21, 1994, abandoned.

[51] Int. Cl.[6] ..... B26B 1/08

[52] U.S. Cl. ..... 30/162; 30/335

[58] Field of Search ..... 30/151, 162, 320, 329, 30/335, 339

[56] References Cited

U.S. PATENT DOCUMENTS

| | | | |
|---|---|---|---|
| 3,192,624 | 7/1965 | Gringer | 30/162 |
| 4,109,380 | 8/1978 | Anderson . | |
| 4,509,260 | 4/1985 | Gringer . | |
| 4,517,741 | 5/1985 | Castelluzzo . | |
| 4,586,256 | 5/1986 | Weimann . | |
| 4,663,845 | 5/1987 | Weimann | 30/162 |
| 4,761,882 | 8/1988 | Silverstein . | |
| 4,939,839 | 7/1990 | Gorst . | |
| 5,054,198 | 10/1991 | Gmoch . | |
| 5,093,994 | 3/1992 | Karas . | |
| 5,099,578 | 3/1992 | Jan . | |

*Primary Examiner*—Hwei Siu Payer

[57] ABSTRACT

A utility knife has a handle providing a cavity and an opening at one end, and a slide seated in the cavity for sliding movement relative to the opening. Supported on the slide is a knife blade which moves therewith between a position within the cavity and a position projecting outwardly of the opening. The blade has a cutting edge extending along its lower edge, and the slide has a side wall against which the blade is disposed and a base wall upon which a portion of the cutting edge is disposed. The slide has a cam portion configured to produce a horizontal force component on the cutting edge portion of the blade when the cutting edge cuts into the base wall as a result of the cutting force applied by the user on the outwardly projecting blade.

20 Claims, 2 Drawing Sheets

UTILITY KNIFE WITH IMPROVED SLIDE

CROSS-REFERENCE TO RELATED APPLICATION

The present application is a continuation-in-part application of our application Ser. No. 08/184,970, filed Jan. 21, 1994, now abandoned.

BACKGROUND OF THE INVENTION

The present invention relates to a utility knife, and more particularly, to a utility knife with a slide fabricated of a material into which the blade will cut.

Utility knives are well known and used for a wide variety of tasks because of their replaceable razor-like blades. The bulk of the utility knives have a slide element upon which the blade is supported for movement into and outwardly of the casing or handle.

In recent years, some utility knives have been fabricated from synthetic resin because molding of resin enables precision fabrication at low cost. Other slides have been fabricated of die cast zinc and aluminum for the same reason. However, a slide made of synthetic resin or a relatively soft metal is prone to being cut into or sheared by the blade so that harder metal slides have been preferred. Use of low friction resins such as polyamides and polyacetals provide low friction slides but have a tendency to shear at their base wall having the blade edge bearing thereon. A similar problem exists with respect to slides formed from softer metals.

A number of prior art devices have sought to restrict unwanted inward movement and upward rotation of the rear or inner end of the blade relative to the slide by means of a stop on the slide against which the inner end of the blade abuts. However, none of these devices has sought to translate the forces causing the unwanted cutting or shearing of the slide to non-destructive forces.

It is an object of the present invention to provide a utility knife with a novel slide which reduces the unwanted tendency of the blade to cut into or shear the slide.

It is also an object to provide such a utility knife in which the slide is configured to resist rotational forces acting upon the blade.

It is a further object to provide such a utility knife which may be fabricated readily and economically and readily assembled to provide relatively long-lived operation.

SUMMARY OF THE INVENTION

It has now been found that the foregoing and related objects may be readily attained in a utility knife which has a handle providing a cavity and an opening thereinto at one end thereof, and a slide member seated in the cavity for sliding movement relative to the opening.

A knife blade is supported on the slide member for movement therewith between a stored position within the cavity and a working position wherein the blade has an end portion projecting outwardly of the opening. The blade has a cutting edge portion extending along its lower edge, and the slide member has a side wall against which the side of the blade is disposed and a base wall upon which a portion of the cutting edge is disposed. The blade will cut a workpiece in the working position upon the application of a downward cutting force on the handle applied by the user of the knife. The slide member also has a cam portion configured to produce a horizontal force component on the cutting edge portion of the blade when the cutting edge cuts into the base wall as a result of the cutting force applied by the user on the blade.

In one embodiment, the cam portion provides a cam surface extending downwardly at an angle from the side wall to the base wall.

In another embodiment, the cam portion is provided by a boss of rectangular cross section at the juncture of the base and side walls. In still another embodiment, the base wall has a groove of triangular cross section extending parallel to the side wall, with the cam portion comprising a side wall of the groove. Moreover, the cam portion may extend along only a portion of the length of the blade.

In some embodiments, the handle has an inner surface defining the cavity and a portion of the surface opposite the side wall of the slide member is configured to oppose the horizontal force component on the cutting edge portion. This portion generally provides a cam surface extending along a portion of the blade to oppose the horizontal force component acting on the cutting edge portion.

Preferably, the slide member has a top wall spaced from and overlying the base wall, and the blade is disposed between the top wall and the base wall. Desirably, the side wall of the slide member has at least one rib spaced above the base wall which positions the blade in a substantially vertical orientation, and at least one rib is provided on the side wall at a point spaced from the opening so that the rear edge of the blade bears thereagainst to limit its motion.

DETAILED DESCRIPTION OF THE PREFERRED EMBODIMENTS

Figure 1:
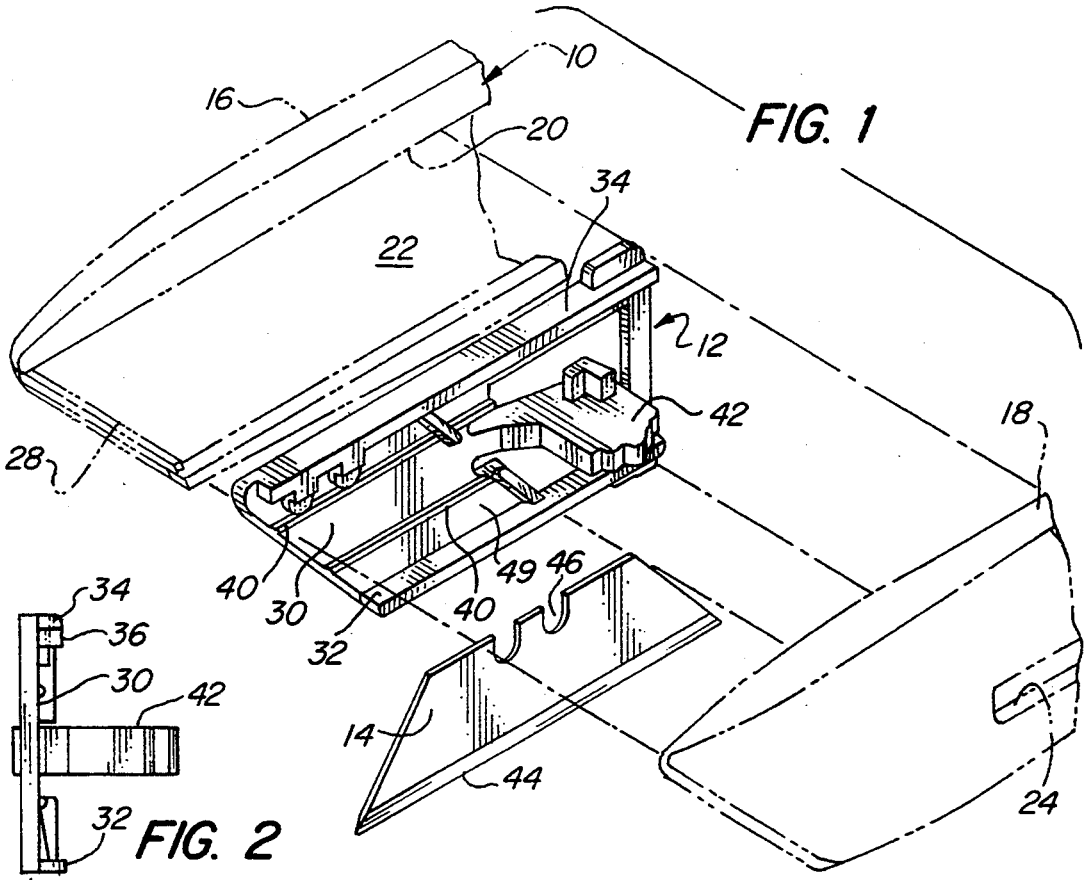
FIG. 1 is a fragmentary exploded view of a utility knife with an improved slide embodying the present invention and showing the handle portion in phantom line.
Figure 2:
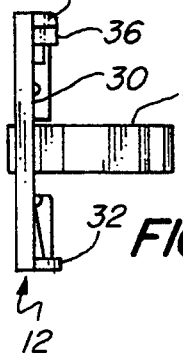
FIG. 2 is a front elevational view of the slide.

Turning first to FIGS. 1–6, a utility knife with an improved slide embodying the present invention is illustrated therein as having a handle generally designated by the numeral 10, a slide generally designated by the numeral 12 slidably mounted within the handle 10, and a knife blade generally designated by the numeral 14 mounted on the slide 12 for sliding movement therewith.

As best seen in FIG. 1, the handle 10 is comprised of a pair of mating halves 16, 18 which provide a cavity 20 therewithin and an opening 28 at the forward end thereof. The cavity 20 is defined by the inner surface 22 of the left handle half 16 and the inner surface (not shown) of the right handle half 18. The right handle half 18 also has a slot 24 therein.

As shown in FIGS. 1–5, the slide 12 is elongated and has a side wall 30, a base wall 32 and a top wall 34 which cooperate to define a recess in which the blade 14 is seated. Bosses 36 depend from the top wall 34 to the recesses 46 in the upper edge of the blade 14 in position within the slide 12. A pair of ribs 38 are disposed diagonally on the side wall 30 adjacent the rearward end thereof and the rear edge of the blade 14 abuts thereagainst to prevent its rotation. A pair of vertically spaced ribs 40 extend longitudinally along the side wall 30 to orient the blade in a vertical position within the cavity 20.

Figure 3:
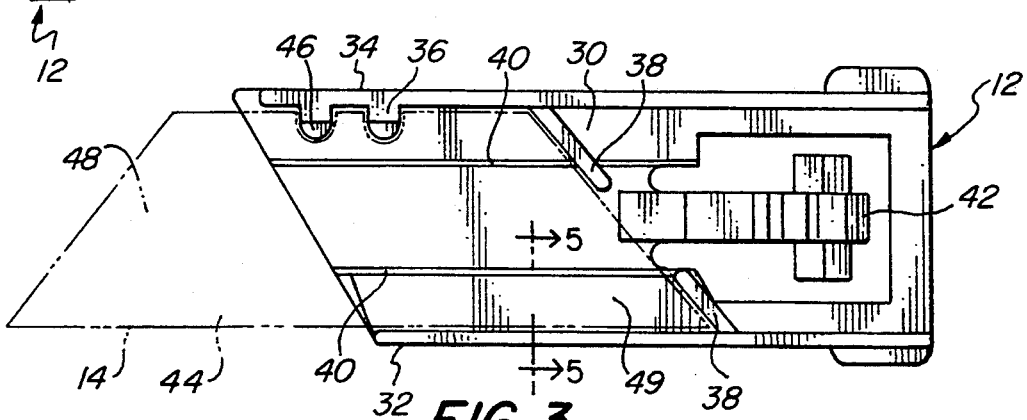
FIG. 3 is a side elevational view of the slide thereof with the blade shown in phantom line.
Figure 4:
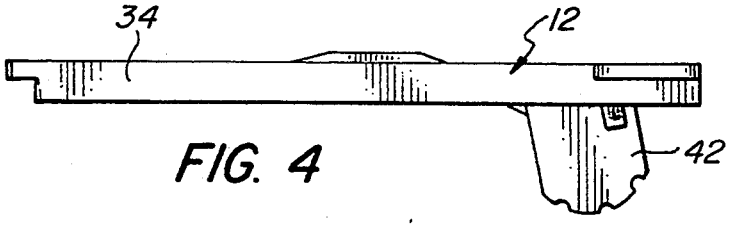
FIG. 4 is a top plan view of the slide.

As seen in FIG. 3, the blade 14 has its cutting edge 44 disposed on the base wall 32 and its forward end portion 48 projects beyond the forward end of the slide 14.

The slide 12 also has a horizontally extending tab 42 on the side wall 30 which projects through the slot 24 in the right handle half 18 to enable the user to move the slide 12 within the cavity 20 between a position wherein the blade 14 is fully within the cavity 20 and a position wherein the forward end portion 48 extends outwardly of the handle 10 through the opening 28 so that the blade 14 may be utilized for cutting.

Figure 5:
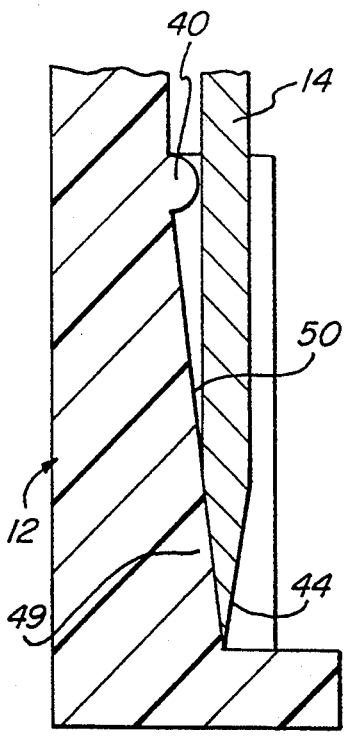
FIG. 5 is a fragmentary sectional view of the slide and the blade of FIG. 3 along the line 5—5 thereof, and drawn to an enlarged scale.

As best seen in FIG. 5, the slide 12 is configured to provide a cam portion 49 below the lower rib 40 adjacent the juncture of the base wall 32 and side wall 30. The cam portion 49 provides an inclined planar cam surface 50 which extends along the length of the blade 14 supported on the base wall 32. As seen in FIG. 5, the blade 14 has a cooperating angle on its cutting edge portion 44 so that the blade is positioned vertically by the cam surface 50 and ribs 40.

As the user applies a downward cutting force to the projecting portion of the blade 14, it will have a tendency to cut into the base wall 32 of the slide 12. As the blade 14 begins to cut into the base wall 32, the cutting edge portion 44 of the blade 14 contacts and bears against the cam surface 50 as it is pushed downwardly. This produces a horizontal force component acting on the cutting edge portion 44 of the blade 14 which reduces the vertical shearing component applied to the base wall 32. As a result, this reduces the tendency for further cutting or shearing of the base wall 32 by the cutting edge 44.

Additionally, the cam portion 49 acts as a gusset between the side wall 30 and the base wall 32 to prevent deflection of the base wall 32 under the force applied through the cutting edge 44.

Figure 6:
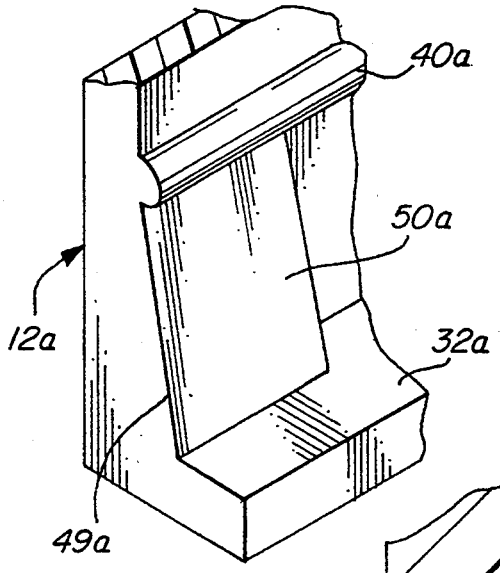
FIG. 6 is a fragmentary perspective view of a modification of the slide of FIG. 5.

FIG. 6 shows an alternate embodiment of the slide which is generally designated by the numeral 12a in which the cam portion **49*a*** extends along only the front portion of the length of the blade (not shown).

Figure 7:
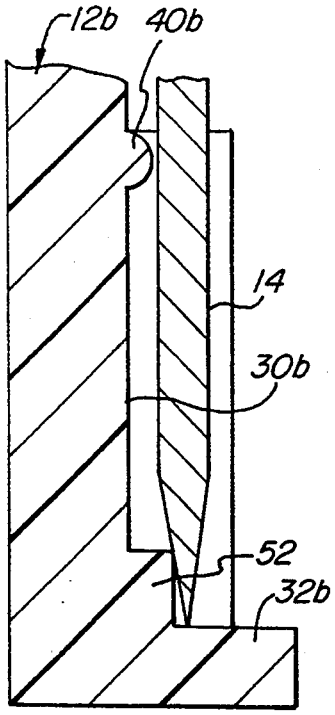
FIG. 7 is a view similar to FIG. 5 showing an alternate embodiment of a slide embodying the present invention.
Figure 8:
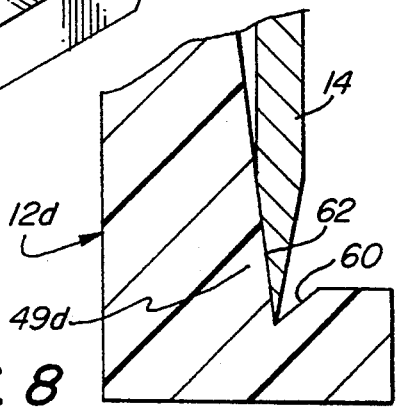
FIG. 8 is a view similar to FIG. 5 showing a further embodiment of a slide embodying the present invention.

Referring next to FIGS. 7 and 8, two alternate embodiments of the slide 12 are shown.

Referring specifically to FIG. 7, the slide **12*b* has a cam portion which is provided by a boss or step 52 of rectangular cross section positioned at the juncture of the side wall 30*b* and the base wall 32*b*** and which is of relative small height.

Referring to FIG. 8, the slide **12*d* includes a groove 60 of triangular cross section cooperating with the planar cam surface 62 provided by the cam portion 49*d*, and the cam surface 62 comprises one side wall of the groove 60. The angle of the opposite wall of the groove 60** is shallower.

Figure 9:
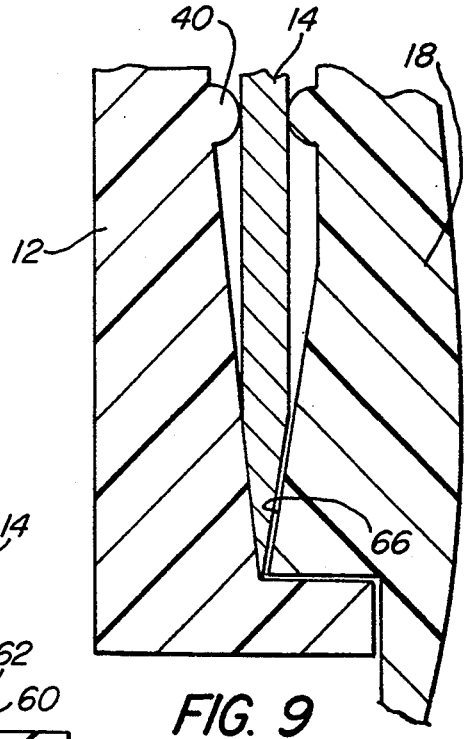
FIG. 9 is a view similar to FIG. 5 but including an alternate handle configuration.

In FIG. 9, the right handle half 18 has its inner surface configured to provide a cam surface 66 extending along a portion of the knife blade **14*d* and configured to oppose the horizontal force component acting on the blade 14**. Thus, it can be seen from the foregoing detailed specification and attached drawings that the utility knife of the present invention reduces the unwanted tendency of the blade to cut into and shear the slide. The cam portion of the slide also resists flexure of the base wall under load exerted through the blade. The utility knife may be fabricated readily and economically and readily assembled to provide long-lived operation.

As a result of the cam portion of the slide, the vertical force which might produce cutting of the blade into the base wall of the slide is in part translated into a horizontal force component acting on the cutting edge. This reduces the vertical cutting force so as to enable longer life for synthetic resin and softer metal slides. This enables use of synthetic resin and softer metals such as zinc and aluminum for the slides for utility knives while not significantly reducing the useful life of the utility knife.

Having thus described the invention, what is claimed is:

1. A utility knife comprising:

(a) a handle providing a cavity and an opening thereinto at one end thereof;

(b) a slide member slidably seated in said cavity for sliding movement therein relative to said opening; and (c) a knife blade supported on said slide member for movement therewith between a stored position in which said blade is fully disposed within said cavity and a working position wherein said blade has an end portion projecting outwardly of said opening, said blade having a cutting edge extending along its lower edge, said slide member having a side wall against which said blade is disposed, a base wall upon which a portion of said cutting edge is disposed, and a top wall spaced from and overlying said base wall, said blade being disposed between said top wall and said base wall, said side wall of said slide member having at least one rib spaced above said base wall orienting said blade in a substantially vertical orientation, said side wall also having at least one rib on said side wall spaced from said opening against which the rear edge of said blade bears to limit its motion, said blade being adapted to cut a workpiece when in said working position upon the application of a downward cutting force on said handle applied by the user of said knife, said slide member having a cam portion configured to produce a horizontal force component on said cutting edge portion of said blade when said cutting edge cuts into said base wall as a result of the cutting force applied by the user on said blade.

2. The utility knife in accordance with claim 1 wherein said cam portion provides a cam surface extending downwardly at an angle from said side wall to said base wall.

3. The utility knife in accordance with claim 2 wherein said cam surface is planar.

4. The utility knife in accordance with claim 2 wherein said slide member is fabricated from synthetic resin.

5. The utility knife in accordance with claim 2 wherein said base wall has a groove of triangular cross section extending parallel to said side wall, and a portion of said cam surface comprises a side wall of said groove.

6. The utility knife in accordance with claim 2 wherein said cam surface extends along only a portion of said blade.

7. The utility knife in accordance with claim 1 wherein said cam portion is provided by a boss of rectangular cross section at the juncture of said base and side walls.

8. The utility knife in accordance with claim 1 wherein said handle has an inner surface defining said cavity and a portion of said inner surface opposite said side wall of said slide member provides a cam surface extending along at least a portion of said blade to oppose said horizontal force component on said cutting edge.

9. A utility knife comprising:

(a) a handle providing a cavity and an opening thereinto at one end thereof;

(b) a slide member slidably seated in said cavity for sliding movement therein relative to said opening;

(c) a knife blade supported on said slide member for movement therewith between a stored position in which said blade is fully disposed within said cavity and a working position wherein said blade has an end portion projecting outwardly of said opening, said blade having a cutting edge portion extending along its lower edge, said slide member having a side wall against which said blade is disposed and a base wall upon which a portion of said cutting edge portion is disposed, said blade being adapted to cut a workpiece when in said working position upon the application of a downwardly cutting force on said handle applied by the user of said knife, said slide member having a cam portion configured to produce a horizontal force component on said cutting edge portion of said blade when said cutting edge portion cuts into said base wall as a result of the cutting force applied by the user on said blade.

10. The utility knife in accordance with claim 9 wherein said cam portion provides a cam surface extending downwardly at an angle from said side wall to said base wall.

11. The utility knife in accordance with claim 10 wherein said cam surface is planar.

12. The utility knife in accordance with claim 10 wherein slide member is fabricated from synthetic resin.

13. The utility knife in accordance with claim 10 wherein said base wall has a groove of triangular cross section extending parallel to said side wall, and a portion of said cam surface comprises a side wall of said groove.

14. The utility knife in accordance with claim 10 wherein said cam surface extends along only a portion of said blade.

15. The utility knife in accordance with claim 9 wherein said cam portion is provided by a boss of rectangular cross section at the juncture of said base and side walls.

16. The utility knife in accordance with claim 9 wherein said handle has an inner surface defining said cavity and a portion of said inner surface opposite said side wall of said slide member is configured to oppose said horizontal force component on said cutting edge portion.

17. The utility knife in accordance with claim 16 wherein said portion of said surface opposite said side wall of said slide member provides a cam surface extending along at least a portion of said blade to oppose said horizontal force component on said cutting edge portion.

18. The utility knife in accordance with claim 9 wherein said slide member has a top wall spaced from and overlying said base wall, said blade being disposed between said top wall and said base wall.

19. The utility knife in accordance with claim 9 wherein said side wall of said slide member has at least one rib spaced above said base wall, said rib spacing said blade from said side wall in a substantially vertical orientation.

20. The utility knife in accordance with claim 9 wherein said slide member has at least one rib on said side wall spaced from said opening, the rear edge of said blade bearing thereagainst to limit its motion.

* * * * *